US005569406A

United States Patent [19]

Barnhorst et al.

[11] Patent Number: 5,569,406

[45] Date of Patent: Oct. 29, 1996

[54] STAMPING LUBRICANTS

[75] Inventors: Jeff A. Barnhorst; Roger H. Garst, both of Cincinnati, Ohio; Ronald H. Gordon, Marlboro, N.J.; Eugene R. Zehler, West Chester, Ohio

[73] Assignee: Henkel Corporation, Plymouth Meeting, Pa.

[21] Appl. No.: 404,783

[22] Filed: Mar. 15, 1995

[51] Int. Cl.[6] ..... C10M 173/02; C10M 145/26

[52] U.S. Cl. ..... 508/431; 72/42; 508/496

[58] Field of Search ..... 252/49.3, 52 A

[56] References Cited

U.S. PATENT DOCUMENTS

| | | | |
|---|---|---|---|
| 3,769,215 | 10/1973 | Sturwold et al. | 252/49.5 |
| 4,384,965 | 5/1983 | Heltsten et al. | 252/49.3 |
| 4,555,549 | 11/1985 | Camp et al. | 252/52 A |
| 4,606,837 | 8/1986 | McEhtire et al. | 252/49.3 |
| 4,661,280 | 4/1987 | Ouhadi et al. | 252/52 A |
| 5,259,970 | 11/1993 | Kanamori et al. | 252/49.3 |
| 5,286,300 | 2/1994 | Hnatin et al. | 252/49.3 |
| 5,399,274 | 3/1995 | Marcus | 252/49.3 |

*Primary Examiner*—Ellen M. McAvoy

*Attorney, Agent, or Firm*—Wayne C. Jaeschke; John E. Drach; Henry E. Millson, Jr.

[57] ABSTRACT

Stamping lubricant compositions which exhibit improved lubricity and methods for reducing friction and wear utilizing said stamping lubricant compositions.

29 Claims, No Drawings

STAMPING LUBRICANTS

FIELD OF THE INVENTION

The invention relates to stamping lubricants having decreased volatile organics content (VOC) values and improved lubricity.

BACKGROUND OF THE INVENTION

Stamping lubricants are currently used in many aspects of the manufacturing industry such as, for example, in cooling fin dies and punches. The primary function of these stamping lubricants is to reduce friction and wear which in turn leads to extended die and punch lifetime and reduced remachining costs. Unfortunately, many of the currently available stamping lubricants do not provide sufficient lubricity and premature die and punch wear continues to be a major problem which costs the manufacturing industry hundreds of thousands of dollars annually. Additionally, many of the currently available stamping lubricants contain ingredients which impart high VOC values to the compositions and such compositions are coming under increasing scrutiny and restriction by the federal and state regulatory agencies. Thus, a need exists for the development of stamping lubricants which have decreased VOC values and improved lubricity in order to meet both the needs of the manufacturing industry and the regulatory requirements of the various federal and state regulatory agencies.

SUMMARY OF THE INVENTION

The invention relates to a stamping lubricant composition comprising:

I)

(a) up to about 69% by weight of mineral spirits;

(b) up to about 8% by weight of a $(POP)_n(POE)_mC_8$–$C_{18}$ alkylalcohol wherein n and m are independently a number from about 3 to about 8;

(c) up to about 12% by weight of an alkali metal salt of a phosphate ester of a $(POE)_{n'}C_8$–$C_{18}$ alkylalcohol wherein n' is a number from about 3 to about 8; and (d) up to about 25% by weight of a polyester of a dimer acid; or

II)

(a) up to about 95% by weight of water;

(b) optionally up to about 3% by weight of a $(POP)_n(POE)_mC_8$–$C_{18}$ alkylalcohol wherein n and m are independently a number from about 3 to about 8;

(c) up to about 4% by weight of an alkali metal salt of a phosphate ester of a $(POE)_{n'}C_8$–$C_{18}$ alkylalcohol wherein n' is a number from about 3 to about 8;

(d) up to about 8% by weight of a polyester of a dimer acid; or up to about 12% by weight of a polyester derivative; and (e) up to about 6% by weight of a trialkanolamine.

Preferred compositions of the invention are those which comprise:

I)

(a) from about 60% to about 69% by weight of mineral spirits;

(b) from about 3% to about 8% by weight of a $(POP)_n(POE)_mC_8$–$C_{18}$ alkylalcohol wherein n and m are independently a number from about 3 to about 8;

(c) from about 3% to about 12% by weight of an alkali metal salt of a phosphate ester of a $(POE)_{n'}C_8$–$C_{18}$ alkylalcohol wherein n' is a number from about 3 to about 8; and (d) from about 20% to about 25% by weight of a polyester of a dimer acid; or

II)

(a) from about 70% to about 95% by weight of water;

(b) optionally from about 0.5% to about 3% by weight of a $(POP)_n(POE)_mC_8$–$C_{18}$ alkylalcohol wherein n and m are independently a number from about 3 to about 8;

(c) from about 0.1% to about 4% by weight of an alkali metal salt of a phosphate ester of a $(POE)_{n'}C_8$–$C_{18}$ alkylalcohol wherein n' is a number from about 3 to about 8;

(d) from about 2% to about 8% by weight of a polyester of a dimer acid; or from about 3% to about 12% by weight of a polyester derivative; and (e) from about 1% to about 6% by weight of a trialkanolamine.

Particularly preferred compositions of the invention are those which comprise:

I)

(a) from about 63% to about 66% by weight of mineral spirits;

(b) from about 4% to about 6% by weight of a $(POP)_n(POE)_mC_8$–$C_{18}$ alkylalcohol wherein n and m are independently a number from about 3 to about 8;

(c) from about 6% to about 10% by weight of an alkali metal salt of a phosphate ester of a $(POE)_{n'}C_8$–$C_{18}$ alkylalcohol wherein n' is a number from about 3 to about 8;

(d) from about 21% to about 23% by weight of a polyester of a dimer acid; and (e) from about 0.15% to about 0.20% of a copper corrosion inhibitor; or

II)

(a) from about 80% to about 95% by weight of water;

(b) optionally from about 1% to about 2% by weight of a $(POP)_n(POE)_mC_8$–$C_{18}$ alkylalcohol wherein n and m are independently a number from about 3 to about 8;

(c) from about 0.3% to about 3% by weight of an alkali metal salt of a phosphate ester of a $(POE)_{n'}C_8$–$C_{18}$ alkylalcohol wherein n' is a number from about 3 to about 8;

(d) from about 3% to about 7% by weight of a polyester of a dimer acid; or from about 5% to about 11% by weight of a polyester derivative;

(e) from about 1% to about 3% by weight of a trialkanolamine; and (f) from about 0.15% to about 0.20% of a copper corrosion inhibitor.

Especially particularly preferred compositions of the invention are those which comprise:

I)

(a) from about 63% to about 66% by weight of mineral spirits;

(b) from about 4% to about 6% by weight of a $(POP)_6(POE)_6C_{10}$ alkylalcohol;

(c) from about 6% to about 10% by weight of the alkali metal salt of a phosphate ester of a $(POE)_6C_{10}$ alkylalcohol;

(d) from about 21% to about 23% by weight of a polyester of a dimer acid which comprises the derivative produced by the reaction of a $C_{36}$ dimer acid with a polyethylene glycol having an average molecular weight of from about 200 to about 500, and with a $C_5$–$C_8$ linear or branched alcohol; and (e) from about 0.15% to about 0.20% of a copper corrosion inhibitor; or

II)

(a) from about 80% to about 95% by weight of water;

(b) optionally from about 1% to about 2% by weight of a $(POP)_6(POE)_6C_{10}$ alkylalcohol;

(c) from about 0.3% to about 3% by weight of the alkali metal salt of a phosphate ester of a $(POE)_6C_{10}$ alkylalcohol;

(d) from about 3% to about 7% by weight of a polyester of a dimer acid which comprises the derivative produced by the reaction of a $C_{36}$ dimer acid with a polyethylene glycol having an average molecular weight of from about 200 to about 500, and with a $C_5$–C8 linear or branched alcohol; or from about 5% to about 11% by weight of a polyester derivative which comprises the derivative produced by the condensation reaction of a polyethylene glycol having an average molecular weight of about 200 to about 600, with a $C_{32}$–$C_{36}$ dimer acid and with a short-chain dibasic acid containing from about 6 to about 10 carbon atoms;

(e) from about 1% to about 3% by weight of a trialkanolamine; and (f) from about 0.15% to about 0.20% of a copper corrosion inhibitor.

The most preferred compositions of the invention comprise:

I)

(a) 65% by weight of mineral spirits;

(b) 5% by weight of $(POP)_6(POE)_6$isodecanol;

(c) 8% by weight of the potassium salt of the phosphate ester of $(POE)_6$isodecanol;

(d) 22% by weight of the polyester of a dimer acid which comprises the derivative produced by the reaction of a C36 dimer acid with a polyethylene glycol having an average molecular weight of about 400, and with 2-ethyl-1-hexanol; and (e) 0.15% by weight of a copper corrosion inhibitor; or

II)

(a) 88.5% by weight of water;

(b) 1.35% by weight of $(POP)_6(POE)_6$isodecanol;

(c) 2.2% by weight of the potassium salt of the phosphate ester of $(POE)_6$isodecanol;

(d) 5.95% by weight of the polyester of a dimer acid which comprises the derivative produced by the reaction of a $C_{36}$ dimer acid with a polyethylene glycol having an average molecular weight of about 400, and with 2-ethyl-1-hexanol;

(e) 2.0% by weight of triethanolamine; and (f) 0.15% by weight of a copper corrosion inhibitor; or

III)

(a) 90% by weight of water;

(b) 0.6% by weight of the potassium salt of the phosphate ester of $(POE)_6$isodecanol;

(c) 9.4% by weight of a polyester derivative which comprises the derivative produced by the condensation reaction of a polyethylene glycol having an average molecular weight of about 400, with a $C_{36}$ dimer acid and with azelaic acid;

(d) 1.5% by weight of triethanolamine; and (e) 0.15% by weight of a copper corrosion inhibitor.

The invention also relates to a method for reducing friction and wear in dies and punches which comprises contacting said dies and punches with an effective friction and wear reducing amount of a stamping lubricant composition of the invention.

DETAILED DESCRIPTION INCLUSIVE OF THE PREFERRED EMBODIMENTS

The term $C_8$–$C_{18}$ alkylalcohol as used herein means $C_8$–$C_{18}$ linear or branched alkylalcohols such as octanol, 2,4,4 -trimethyl-1-pentanol, nonanol, 2,6-dimethyl-4-heptanol, decanol, isodecanol, undecanol, dodecanol, tridecanol, pentadecanol, hexadecanol, heptadecanol, octadecanol, and the like. The alkylalcohol is preferably a $C_8$–$C_{14}$ alkylalcohol, especially a $C_{10}$ alkylalcohol and in particular isodecanol.

The abbreviation POP as used herein refers to the average number of polyoxypropylene units which are attached to the $C_8$–$C_{18}$ alkylalcohol. The average number of polyoxypropylene units is typically from about 3 to about 8, preferably from about 5 to about 7 and especially about 6.

The abbreviation POE as used herein refers to the average number of polyoxyethylene units which are attached to the $C_8$–$C_{18}$ alkylalcohol. The average number of polyoxyethylene units is typically from about 3 to about 8, preferably from about 5 to about 7 and especially about 6.

The term alkali metal salt as used herein refers to lithium, sodium, or potassium salts, preferably the potassium salts.

The term polyester of a dimer acid refers to the derivative produced by reacting from about 3 moles to about 4 moles, preferably about 3.56 moles, of a $C_{32}$–C52 dimer acid with about 1 mole of a polyalkylene glycol having an average molecular weight in the range of from about 100 to about 600 and with about 2 moles to about 3 moles, preferably about 2.4 moles of a $C_4$–$C_{18}$ linear or branched alcohol. The $C_{32}$–$C_{52}$ dimer acid is the reaction product of the dimerization of two moles of an unsaturated $C_{16}$–$C_{26}$ monocarboxylic acid. For example, a typical dimer acid which can be used in practicing the instant invention is a $C_{36}$ dimer acid, e.g. EMPOL® 1016, obtained by the dimerization of two moles of a $C_{18}$ unsaturated monocarboxylic acid, such as oleic acid or linoleic acid, or mixtures thereof, e.g. tall oil fatty acids. Other examples of such dimer acids include, but are not limited thereto, WESTVACO® H240, EMPOL® 1004, EMPOL® 1007, EMPOL® 1008, EMPOL® 1018 and EMPOL® 1016. The dimer acid is preferably a $C_{32}$–$C_{36}$ dimer acid, especially a $C_{36}$ dimer acid and in particular the $C_{36}$ dimer acid EMPOL® 1016 which is commercially available from Henkel Corporation, Emery Group, Cincinnati, Ohio 45249. The polyalkylene glycol is preferably a polyethylene glycol having an average molecular weight in the range of from about 100 to about 600, more preferably a polyethylene glycol having an average molecular weight in the range of from about 200 to about 500 and especially a polyethylene glycol having an average molecular weight of about 400. The $C_4$–$C_{18}$ linear or branched alcohol can be such alcohols as butanol, secbutanol, isobutanol, 3-methyl-1-butanol, pentanol, 2-pentanol, hexanol, 2-hexanol, 2-methyl-2-pentanol, 1-heptanol, 2-heptanol, 1-octanol, 2-octanol, 2-ethyl-1-hexanol, 2,4,4-trimethyl-1-pentanol, nonanol, 2,6-dimethyl-4-heptanol, decanol, isodecanol, undecanol, dodecanol, tridecanol, pentadecanol, hexadecanol, heptadecanol, octadecanol, and the like. The $C_4$–$C_{18}$ linear or branched alcohol is preferably a $C_4$–$C_{10}$ linear or branched alcohol, more preferably a $C_5$–$C_8$ linear or branched alcohol, especially a C6 linear or branched alcohol and in particular 2-ethyl-1-hexanol.

The term polyester derivative as used herein refers to the derivative produced by the condensation reaction of a polyoxyalkylene glycol having an average molecular weight of from about 200 to about 600, with a $C_{32}$–$C_{52}$ dimer acid and with a short-chain dibasic acid containing from about 2 to about 12 carbon atoms. These polyester derivatives are described in, for example, U.S. Pat. No. 3,769,215, issued Oct. 30, 1973, the entire contents of which is incorporated herein by reference. The polyester derivative is preferably produced by the condensation reaction of from about 1.5–2.1 moles of a polyethylene glycol having an average molecular weight of from about 200 to about 600, with about 0.5 moles of a $C_{32}$–$C_{36}$ dimer acid and with about 0.5 moles of a short-chain dibasic acid containing from about 6 to about 10 carbon atoms. The polyester derivative is more preferably produced by the condensation reaction of from about 1.75–2.0 moles of a polyethylene glycol having an average molecular weight of about 400, with about 0.5 moles of a $C_{36}$ dimer acid, for example EMPOL® 1016 or EMPOL® 1018, especially EMPOL® 1016, and with about 0.5 moles of a $C_9$ dibasic acid, especially azelaic acid (commercially available from Henkel Corporation, Emery Group, Cincinnati, Ohio 45249).

The term trialkanolamine as used herein refers to those amines to which are bonded three $C_1$–$C_4$ alkyl alcohol groups and thus includes trimethanolamine, triethanolamine, tripropanolamine, tributanolamine and the like, preferably triethanolamine.

The term copper corrosion inhibitor as used herein refers to the known class of triazole derivative containing copper deactivators, such as, for example, REOMAT® 39 (pour point=<20° C.; viscosity at 40° C.=83 cst) which is commercially available from Ciba-Giegy, Additives Division, Ardsley, N.Y. 10502; and COBRATECH® 911 (Chemical Abstracts Service Registry No. 114502) which is commercially available from PMC Specialties Group Inc., Cincinnati, Ohio 45217.

EXAMPLES

The following examples are meant to further illustrate the instant invention without, however, limiting it thereto.

The following general procedure was used to prepare examples 1 and 2: Odorless mineral spirits or water was added to a container, e.g. an 8 oz. bottle or a large mixing vessel, and then each of the remaining ingredients was added and the mixture was stirred until the solution became clear.

Example 1

| Ingredient | Percent by weight | Weight in grams |
|---|---|---|
| odorless mineral spirits | 65 | 97.5 |
| EMERY ® 6720[1] | 5 | 7.5 |
| EMERY ® 5553[2] | 8 | 12.0 |
| EMERY ® 2902[3] | 22 | 33.0 |
| REOMAT ® 39[4] | 0.15[*] | 0.225 |

[*]Based on a total solution weight of 150 grams.
[1]A $(POP)_6(POE)_6$ isodecanol which is commercially available from Henkel Corporation, Emery Group, Cincinnati, OH 45249.
[2]The potassium salt of the phosphate ester of $(POE)_6$ isodecanol which is commercially available from Henkel Corporation, Emery Group, Cincinnati, OH 45249.
[3]The polyester of a dimer acid which is produced from the reaction of the $C_{36}$ dimer acid EMPOL ® 1016 (which is commercially available from Henkel Corporation, Emery Group) with a polyethylene glycol having an average molecular weight of 400 and with 2-ethyl-1-hexanol. The product is commercially available from Henkel Corporation, Emery Group, Cincinnati, OH 45249.
[4]A triazole derivative containing copper deactivator (commercially available from Ciba-Giegy, Additives Division, Ardsley, New York, 10502).

Example 2

| Ingredient | Percent by weight | Weight in grams |
|---|---|---|
| water | 88.5 | 132.75 |
| EMERY ® 6720[1] | 1.35 | 2.02 |
| EMERY ® 5553[2] | 2.2 | 3.3 |
| EMERY ® 2902[3] | 5.95 | 8.93 |
| triethanolamine | 2.0 | 3.0 |
| REOMAT ® 39[4] | 0.15[*] | 0.225 |

[*]Based on a total solution weight of 150 grams.
[1]A $(POP)_6$ $(POE)_6$ isodecanol which is commercially available from Henkel Corporation, Emery Group, Cincinnati, OH 45249.
[2]The potassium salt of the phosphate ester of $(POE)_6$ isodecanol which is commercially available from Henkel Corporation, Emery Group, Cincinnati, OH 45249.
[3]The polyester of a dimer acid which is produced from the reaction of the $C_{36}$ dimer acid EMPOL ® 1016 (which is commercially available from Henkel Corporation, Emery Group) with a polyethylene glycol having an average molecular weight of 400 and with 2-ethyl-1-hexanol. The product is commercially available from Henkel Corporation, Emery Group, Cincinnati, OH 45249.
[4]A triazole derivative containing copper deactivator (commercially available from Ciba-Giegy, Additives Division, Ardsley, New York, 10502).

Example 3

A mixture of EMERY® 2908, EMERY® 5553 and REOMAT® 39 was mixed throughly and then water, followed by triethanolamine were added and the mixture was throughly mixed.

| Ingredient | Percent by weight | Weight in grams |
|---|---|---|
| water | 90 | 180 |
| EMERY ® 5553[1] | 0.6 | 1.2 |
| EMERY ® 2908[2] | 9.4 | 18.8 |
| triethanolamine | 1.5[*] | 3.0 |
| REOMAT ® 39[3] | 0.15 | 0.3 |

[*]Based on a total solution weight of 200.3 grams.
[1]The potassium salt of the phosphate ester of $(POE)_6$ isodecanol which is commercially available from Henkel Corporation, Emery Group, Cincinnati, OH 45249.
[2]A polyester derivative which is produced by the condensation reaction of a polyethylene glycol having an average molecular weight of about 400, with the $C_{36}$ dimer acid EMPOL ® 1016 (which is commercially available from Henkel Corporation, Emery Group) and with azelaic acid. The product is commercially available from Henkel Corporation, Emery Group, Cincinnati, OH 45249.
[3]A triazole derivative containing copper deactivator (commercially available from Ciba-Giegy, Additives Division, Ardsley, New York, 10502).

Test Procedures

The stamping lubricant compositions of the instant invention were tested for (a) lubricity utilizing the Falex test ASTM method D-2670-88, (b) Volatile Organics Content (VOC) utilizing the test method described in ASTM D-2369-81, part B, and (c) polystyrene compatibility by placing a block of low impact polystyrene in a container half-filled with neat sample (samples which contain all of the ingredients of the instant invention except for the odorless mineral spirits or water), capping the container and then placing the container in an oven at 65°–70° C. for 12 hours. The compositions are polystyrene compatible if they do not dissolve the polystyrene and they are polystyrene incompatible if they dissolve the polystyrene. The test results are illustrated in Table 1.

TABLE 1

| Test procedure | Example Number 1 | 2 | 3 | 4[1] |
|---|---|---|---|---|
| Falex test (steel pin) (seizure load in ft/lbs) | 1600 | 3800 | 4000 | 400 |
| Falex test (aluminum pin and V-blocks) (seizure load in ft/lbs) | 1400 | — | 2700 | — |
| VOC (in %) | 65 | 2 | 1.5 | 90 |
| low impact Polystyrene compatibility (65–70° C.)[*] | comp. | comp. | incomp.[2] | incomp. |

[1]Chem Arrow product 8191-FR (Chemical Abstracts Service Registry No. 64741-65-7) which is a commercially available stamping lubricant which consists of 90% mineral spirits and 10% of a mixture of dioctyl adipate and POE(5) nonylphenol (available from Chem Arrow, Irwindale, California, 91706).
[2]Dissolved by 50% after 12 hours.
[*]The abbreviation comp. stands for compatible and the abbreviation incomp. stands for incompatible.

These test results show that examples 1 to 3, which are representative stamping lubricant compositions of the instant invention, exhibited improved lubricity at significantly lower VOC values than comparative example 4. Additionally, the stamping lubricant compositions of examples 1 and 2 were found to be compatible with polystyrene whereas comparative example 3 was found to be incompatible.

While the present stamping lubricant compositions of the invention have been described and illustrated by reference to certain representative examples and embodiments thereof, such is not to be interpreted as in any way limiting the scope of the instantly claimed invention.

What is claimed is:

1. A stamping lubricant composition comprising:

I)

(a) from about 60 to about 69% by weight of mineral spirits;

(b) from about 3 to about 8% by weight of a $(POP)_n(POE)_mC_8$–$C_{18}$ alkylalcohol wherein n and m are independently a number from about 3 to about 8;

(c) from about 3 to about 12% by weight of an alkali metal salt of a phosphate ester of a $(POE)_{n'}C_8$–$C_{18}$ alkylalcohol wherein n' is a number from about 3 to about 8; and (d) from about 20 to about 25% by weight of a polyester of a dimer acid; or

II)

(a) from about 70 to about 95% by weight of water;

(b) optionally up to about 3% by weight of a $(POP)_n(POE)_mC_8$–$C_{18}$ alkylalcohol wherein n and m are independently a number from about 3 to about 8;

(c) from about 0.1 to about 4% by weight of an alkali metal salt of a phosphate ester of a $(POE)_{n'}C_8$–$C_{18}$ alkylalcohol wherein n' is a number from about 3 to about 8;

(d) from about 2 to about 8% by weight of a polyester of a dimer acid; or from about 3 to about 12% by weight of a polyester derivative; and (e) from about 1 to about 6% by weight of a trialkanolamine.

2. A composition according to claim 1 which further comprises up to about 0.25% by weight of a copper corrosion inhibitor.

3. A composition according to claim 1 which comprises:

I)

(a) from about 63% to about 66% by weight of said mineral spirits;

(b) from about 4% to about 6% by weight of said $(POP)_n(POE)_mC_8$–$C_{18}$ alkylalcohol wherein n and m are independently a number from about 3 to about 8;

(c) from about 6% to about 10% by weight of said alkali metal salt of a phosphate ester of a $(POE)_{n'}C_8$–$C_{18}$ alkylalcohol wherein n' is a number from about 3 to about 8; and (d) from about 21% to about 23% by weight of said polyester of a dimer acid; or

II)

(a) from about 80% to about 95% by weight of said water;

(b) optionally from about 1% to about 2% by weight of said $(POP)_n(POE)_mC_8$–$C_{18}$ alkylalcohol wherein n and m are independently a number from about 3 to about 8;

(c) from about 0.3% to about 3% by weight of said alkali metal salt of a phosphate ester of a $(POE)_{n'}C_8$–$C_{18}$ alkylalcohol wherein n' is a number from about 3 to about 8;

(d) from about 3% to about 7% by weight of said polyester of a dimer acid; or from about 5% to about 11% by weight of said polyester derivative; and (e) from about 1% to about 3% by weight of said trialkanolamine.

4. A composition according to claim 3 which further comprises from about 0.15% to about 0.20% of a copper corrosion inhibitor.

5. A composition according to claim 4 wherein each of n, m, and n' is a number from about 5 to about 7; and the alkylalcohol is a $C_8$–$C_{14}$ alkylalcohol.

6. A composition according to claim 5 wherein said polyester of a dimer acid comprises the derivative produced by the reaction of a $C_{32}$–$C_{36}$ dimer acid with a polyalkylene glycol having an average molecular weight of from about 100 to about 600, and with a $C_4$–$C_{18}$ linear or branched alcohol.

7. A composition according to claim 6 wherein each of n, m, and n' is 6; and the alkylalcohol is a $C_{10}$ alkylalcohol.

8. A composition according to claim 3 wherein in composition II) said polyester of a dimer acid comprises the derivative produced by the reaction of a $C_{32}$–$C_{36}$ dimer acid with a polyethylene glycol having an average molecular weight of from about 100 to about 600, and with a $C_4$–$C_{10}$ linear or branched alcohol.

9. A composition according to claim 8 wherein said polyester of a dimer acid comprises the derivative produced by the reaction of a $C_{36}$ dimer acid with a polyethylene glycol having an average molecular weight of from about 200 to about 500, and with a $C_5$–$C_8$ linear or branched alcohol.

10. A composition according to claim 3 wherein in composition II) said polyester of a dimer acid comprises the derivative produced by the reaction of a $C_{36}$ dimer acid with a polyethylene glycol having an average molecular weight of about 400, and with a $C_6$ linear or branched alcohol.

11. A composition according to claim 10 wherein said $C_6$ linear or branched alcohol is 2-ethyl-1-hexanol and said trialkanolamine is triethanolamine.

12. A composition according to claim 11 which comprises:

(a) 65% by weight of said mineral spirits;

(b) 5% by weight of $(POP)_6(POE)_6$isodecanol;

(c) 8% by weight of the potassium salt of the phosphate ester of $(POE)_6$isodecanol;

(d) 22% by weight of the polyester of a dimer acid; and (e) 0.15% by weight of said copper corrosion inhibitor.

13. A composition according to claim 11 which comprises:

(a) 88.5% by weight of said water;

(b) 1.35% by weight of $(POP)_6(POE)_6$isodecanol;

(c) 2.2% by weight of the potassium salt of the phosphate ester of $(POE)_6$isodecanol;

(d) 5.95% by weight of the polyester of a dimer acid;

(e) 2.0% by weight of triethanolamine; and (f) 0.15% by weight of said copper corrosion inhibitor.

14. A composition according to claim 11 which comprises:

(a) 90% by weight of said water;

(b) 0.6% by weight of the potassium salt of the phosphate ester of $(POE)_6$isodecanol;

(c) 9.4% by weight of the polyester derivative;

(d) 1.5% by weight of triethanolamine; and (e) 0.15% by weight of said copper corrosion inhibitor.

15. A method for reducing friction and wear in dies and punches which comprises contacting said dies and punches with an effective friction and wear reducing amount of a composition according to claim 1.

16. A method for reducing friction and wear in dies and punches which comprises contacting said dies and punches with an effective friction and wear reducing amount of a composition according to claim 2.

17. A method for reducing friction and wear in dies and punches which comprises contacting said dies and punches with an effective friction and wear reducing amount of a composition according to claim 3.

18. A method for reducing friction and wear in dies and punches which comprises contacting said dies and punches with an effective friction and wear reducing amount of a composition according to claim 5.

19. A method for reducing friction and wear in dies and punches which comprises contacting said dies and punches with an effective friction and wear reducing amount of a composition according to claim 7.

20. A method for reducing friction and wear in dies and punches which comprises contacting said dies and punches with an effective friction and wear reducing amount of a composition according to claim 9.

21. A method for reducing friction and wear in dies and punches which comprises contacting said dies and punches with an effective friction and wear reducing amount of a composition according to claim 11.

22. The stamping lubricant composition of claim 1 wherein the composition comprises alternative I).

23. The stamping composition of claim 1 wherein the composition comprises alternative II).

24. The composition of claim 3 wherein in component II) d) said polyester derivative comprises the derivative produced by the condensation reaction of a polyethylene glycol having an average molecular weight of from about 200 to about 600, with a $C_{32}$–$C_{36}$ dimer acid, and with a short-chain dibasic acid containing from about 6 to about 10 carbon atoms.

25. A method for reducing friction and wear in dies and punches which comprises contacting said dies and punches with an effective friction and wear reducing amount of a composition according to claim 24.

26. The composition of claim 24 wherein said polyester derivative comprises the derivative produced by the condensation reaction of a polyethylene glycol having an average molecular weight of about 400, with a $C_{36}$ dimer acid and with a $C_9$ dibasic acid.

27. A method for reducing fiction and wear in dies and punches which comprises contacting said dies and punches with an effective friction and wear reducing amount of a composition according to claim 26.

28. The composition of claim 3 wherein component II) c) is the potassium salt of the phosphate ester of $(POE)_6$isodecanol; component II) d) is a polyester derivative which is the reaction product of a $C_{36}$ dimer acid, PEG 400, and azelaic acid; and component II) e) is triethanolamine.

29. A method for reducing friction and wear in dies and punches which comprises contacting said dies and punches with an effective friction and wear reducing amount of a composition according to claim 28.

* * * * *